United States Patent [19]

Huff et al.

[11] Patent Number: 4,596,607

[45] Date of Patent: Jun. 24, 1986

[54] ALKALINE RESISTANT MANGANESE-NICKEL-ZINC PHOSPHATE CONVERSION COATINGS AND METHOD OF APPLICATION

[75] Inventors: John Huff, Detroit; Ronald W. Zurilla, Farmington Hills, both of Mich.

[73] Assignee: Ford Motor Company, Dearborn, Mich.

[21] Appl. No.: 750,456

[22] Filed: Jul. 1, 1985

[51] Int. Cl.[4] ..... C23C 22/18

[52] U.S. Cl. ..... 148/6.15 Z; 148/31.5

[58] Field of Search ..... 148/6.15 Z

[56] References Cited

U.S. PATENT DOCUMENTS 3,597,283 8/1971 Snee ..... 148/6.15 Z

OTHER PUBLICATIONS

EP0060716 9/22/82.

*Primary Examiner*—Sam Silverberg

*Attorney, Agent, or Firm*—Roger L. May; Keith L. Zerschling

[57] ABSTRACT

A zinc phosphate coating bath and its application to metal is disclosed characterized in that the bath contains 80 to 94, preferably 84 to 94, mole percent nickel cations, 0.5 to 10 mole percent manganese cations and 5.5 to 19.5 mole percent zinc cations together with solubilizing amounts of phosphate ions or phosphate ions in combination with ions of acids other than phosphoric acid.

7 Claims, No Drawings

ALKALINE RESISTANT MANGANESE-NICKEL-ZINC PHOSPHATE CONVERSION COATINGS AND METHOD OF APPLICATION

TECHNICAL FIELD

Zinc phosphate conversion coatings of novel composition are applied to metal substrates to provide a base for paint adhesion and to inhibit the undercutting of paint in a corrosive environment.

PRIOR ART STATEMENT AND BACKGROUND OF THE INVENTION

The use of phosphating compositions for inhibiting corrosion on metal substrates and improving the adhesion of superimposed organic coatings, e.g., paints and lacquers, is an old and crowded art.

Phosphating compositions typically applied by immersion of the product to be coated in a bath solution or by spraying, commonly have been in the form of acidic, aqueous solutions typically containing phosphate ions, an oxidizing agent, and divalent, layer-forming metal cations. The layer-forming ions most commonly included zinc ions used alone or in combination with the ions of other metals.

In U.S. Pat. No. 3,597,283 to Charles T. Snee, the use of zinc ion in the amount 0.5–3.0 grams per liter is combined with nickel ion, 0.05–3.0 grams per liter, or cobalt ion, 0.003–0.7 grams per liter, or copper ion, 0.003–0.7 grams per liter, and magnesium ion 1–8 grams per liter. The presence of magnesium is recited to be essential.

In European Patent Application Publication No. 0060716 assigned to Nippon Paint KK, the use of zinc ion in the amount of 0.5–1.5 grams per liter is combined with 0.6–3 grams per liter of manganese ion. Optionally, the coating solution contains 0.1 to 4 grams per liter nickel ion.

In our U.S. Pat application Ser. No. 735,286 filed Jan. 6, 1984, we demonstrated that the resistance to alkaline dissolution of a zinc phosphate conversion coating on a corrodible metal surface and the corrosion resistance after painting is increased if nickel ions are employed in such a bath in an amount such that they comprise between about 84 and and 94 mole percent of the divalent metal cations in the bath, the remainder being essentially zinc ions.

THE INVENTION

It now has been discovered that improved phosphate conversion coatings can be obtained by employing a small, restricted amount of manganese ion with zinc-/nickel ion coating baths containing the most preferred concentrations of nickel ion or slightly less than the most preferred concentration range for nickel ion when nickel ion is essentially the only divalent metal ion in the coating bath except for zinc. Also, ease of application is enhanced and effective coating with these formulations can be achieved at somewhat lower cost.

THE COATING BATH

More specifically, the coating baths of this invention exclusive of iron, contain about 80 to about 94, preferably 84 to 94, mole percent nickel ion, about 0.5 to about 10 mole percent manganese ion and about 5.5 to about 19.5, preferably 5.5 to 15.5, mole percent zinc ion. These baths also contain phosphate ions, oxidizing agents and, usually, other additives, e.g., fluorides. The zinc cations in the coating bath are maintained at a minimum concentration of 0.2 grams per liter, advantageously at least 0.5 grams per liter. Advantageously, the bath contains at least 2 mole percent, preferably at least 4 mole percent, manganese ion.

A portion of the phosphate anions needed to solubilize the aforementioned metal cations may be substituted by anions such as nitrates, sulfates, and other anions known for this purpose to those skilled in the art. The phosphate ions are commonly introduced by use of phosphoric acid.

The phosphating solution preferably possesses a total acid content of 10–40 points, a free acid content of 0.5–2.0 points, and a total acid/free acid ratio of 10–60.- The number of points of free acid is the number of ml of 0.1 N NaOH required to titrate a 10 ml sample to a brom phenol blue end point and the number of points of total acid is the number of ml of 0.1 N NaOH required to titrate a 10 ml sample to a phenolphthalein end point. When the process is applied to the coating of zinc metal articles or substrates, the solution preferably contains a fluoride selected from the group consisting of a simple fluoride, fluoroborate, fluorosilicate, or other complex fluoride. It is also preferable that the phosphate solution be maintained at a pH of 2.5–3.5 and contain oxidizing agents in sufficient amount to accelerate deposition of an alkaline resistant coating. Oxidizing agents typically used in this art and which are suitable for use with this invention include, but are not limited to nitrite, chlorate, nitrate, peroxide, aromatic nitro compounds, and combinations thereof. The preferred bath temperature range while the method is being carried out is 100–140° F. (38–60° C.). The exposure of the metal article to such solution preferably is for a time of 30–120 seconds. In particular applications, higher and lower temperatures and much shorter and much longer exposure times may be preferred. It is desirable that the nitrite, used as an accelerator, be used in an amount of 0.5–2.5 points or 0.03–0.15 g/l of solution as $NaNO_2$. The number of points of nitrite in the phosphate bath is the number of ml. of 0.042 N $KM_nO_4$ required to titrate a 25 ml. sample to a permanent pink color.

The substrate preferably is exposed to the phosphating solution for a sufficient time and at a sufficient temperature and pH (i.e., 30–120 seconds, 65–140° F., 2.5–3.5 pH) to chemically react and deposit a coating of phosphate on the substrate, after which excess solution is removed from the coated substrate. The initial bath is advantageously made up from a bath concentrate which is diluted with water and usually rendered more basic with alkali prior to use. Such a concentrate advantageously contains about 2 to about 9 grams/liter manganese ion, about 6 to about 15 grams/liter zinc ion and about 82 to about 95 grams/liter nickel ion with solubilizing amounts of phosphoric acid, a portion of which may be replaced with nitric acid.

It is also advantageous to employ a concentrated phosphate solution to replenish the phosphate bath as it is used throughout a series of article coatings. The concentrations of nickel and manganese relative to zinc in the bath will rise during deposition, since zinc deposits at a more rapid rate than either nickel or manganese. Hence replenishment concentrates contain more zinc relative to nickel and manganese than do starting bath compositions in order to maintain the desired bath concentrations during operation over extended periods of time. Determination of the percentage composition of the replenishment concentrate must take into consideration all of the operating variables including the composition of the deposited coatings. Once those rates are determined, it is advisable to replenish at regular intervals using a replenishment concentrate of constant composition.

A replenishment concentrate advantageously contains 3 to about 15 grams/liter manganese ion, about 40 to about 60 grams/liter zinc ion and about 60 to about 90 grams/liter nickel ion with solubilizing amounts of phosphoric acid, a portion of which may be replaced with nitric acid.

The product resulting from the practice of this invention as characterized by a phosphate film in which the predominant structure is a mixed metal phosphate wherein the additive concentrations of nickel and manganese constitute in excess of 14.5, preferably in excess of 15, mole percent of the cations of the coating and the nickel concentration is preferably at least 11 mole percent, exclusive of any iron present.

SUBSTRATE

The substrate is preferably selected from the group consisting of iron, steel, aluminum, zinc and their respective alloys. When the substrate is either zinc or aluminum, the phosphate solution advantageously contains 0.1–4.0 g/l, in some embodiments preferably 0.1–2.5 g/l, fluoride ion to enhance the formation of zinc phosphate coating.

THE COATING

The resulting coated product is characterized by unusually good resistance to alkali dissolution and by its excellent chemical bonding to the substrate. The product of this process is particularly characterized by a significantly improved corrosion resistance after painting.

The following examples further illustrate the present invention. It is to be understood that these examples are for illustrative purposes and are not to be construed as defining the scope of this invention which is set forth in the appended claims:

EXAMPLES

Concentrate A was prepared by mixing sufficient quantities of water, nickel carbonate, zinc oxide, phosphoric acid, nitric acid and sodium silicofluoride ($Na_2SiF_6$) to provide a concentrate solution containing 91 grams/liter nickel ions, 12.1 grams/liter zinc ions, 218 grams/liter phosphate ions, 125 grams/liter nitrate ions, and 22 grams/liter fluoride ions.

Concentrate B was prepared by mixing sufficient quantities of water, nickel oxide, phosphoric acid, nitric acid and sodium silicofluoride to provide a concentrate solution containing 65.4 grams/liter nickel ions, 343 grams/liter phosphate ions, 8.3 grams/liter nitrate ions and 11.7 grams/liter fluoride ions.

Concentrate C was prepared by mixing sufficient quantities of water, zinc carbonate, phosphoric acid and sodium silicofluoride to provide a concentrate solution containing 31 grams/liter zinc ions, 348 grams/liter phosphate ions and 10 grams per liter fluoride ions.

Concentrates A, B and C were mixed together with water to prepare a solution. To this solution was added sodium hydroxide (in some instances both sodium hydroxide and sodium carbonate) to obtain the desired free acid level and sodium nitrite to serve as an oxidizing agent. Additional sodium silicofluoride was added to raise the fluoride ion level to that shown in the following tests. For the tests which included manganese ions, manganese nitrate or manganese carbonate was added to the solutions to be used prior to the addition of sodium hydroxide.

Coating baths made up in the aforedescribed order and having different concentrations of the aforementioned materials as set forth in the foregoing examples were prepared and coatings deposited therefrom. In some of these tests a bath was initially formed in the above described manner and used for one or more tests was adjusted by further dilution and/or the addition of such components to provide the concentrations used for the next test.

Steel panel of three types were selected for phosphating. The first type, designated as "X" steel, was a commercial available steel test panel having very low surface carbon contamination, typically in the range of less than 1 mg/m$^2$ (0.093 mg/ft$^2$). The second type of panel designated "Y" steel, was cut from commercially available steel known to have surface carbon values in the range of 5.3 to 6.5 mg/m$^2$ (0.49 to 0.60 mg/ft$^2$), and to be subject to early salt spray failure in tests with spray paint primers applied over conventional zinc phosphate. The third type, designated "Z" steel, was commercially available hot-dipped galvanized steel. In each test hereinafter designated by an Example No., (as shown in Table I) phosphate coatings were deposited on X steel panels, Y steel panels and Z steel panels. The steel panels measuring 4" × 12" were spray cleaned for two minutes with a fresh, conventional alkaline cleaner having a strength of 4 to 6 points and spray rinsed for 25 seconds with hot tap water for 30 seconds and then spray rinsed with deionized water containing titanium conditioning compound, Parcolene Z, a trademark of Parker Chemical Company. Each such panel was spray phosphated for two minutes with a phosphate bath prepared as the above described. The phosphated panels were then spray rinsed with room temperature deionized water for 30 seconds at ambient temperatures and dried in an oven at 82° C. for five minutes. None of the phosphated panels were post-treated with an inhibitor rinse. Some of these panels were used for coating analysis while others were used for testing for corrosion resistance. In each example coating analysis was made using a X steel panels and the analytical results are shown in Table II. The panels selected for corrosion testing were first painted with commercially available paints.

TABLE I

| Example | PHOSPHATE BATH CONDITION | | | | | | BATH TEMPERATURE, °F. | | | MOLE PERCENT METAL CATIONS IN PHOSPHATE BATH | | |
|---|---|---|---|---|---|---|---|---|---|---|---|---|
| | TA | FA | $NO_2^-$ | $F^-$ | $PO_4^{-3}$ | $NO_3^-$ | | Cleaner | Ti Rinse | | | |
| No. | (1) | (2) | (3) | (4) | (5) | (6) | $PO_4^{-3}$ | (7) | (8) | $Ni^{+2}$ | $Zn^{+2}$ | $Mn^{+2}$ |
| 1. | 17.3 | 0.8 | 1.5 | 0.92 | 5.88 | 6.13 | 134 | 134 | 112 | 84.0 | 16.0 | 0 |
| 2. | 20.7 | 0.7 | 1.5 | 1.48 | 10.02 | 7.80 | | | | 87.0 | 13.0 | 0 |
| 3. | 34.5 | 1.0 | 1.6 | 1.44 | 14.3 | 14.3 | 130 | 131 | 90 | 93.8 | 6.2 | 0 |

TABLE I-continued

| Example No. | PHOSPHATE BATH CONDITION TA (1) | FA (2) | $NO_2^-$ (3) | $F^-$ (4) | $PO_4^{-3}$ (5) | $NO_3^-$ (6) | BATH TEMPERATURE, °F. $PO_4^{-3}$ | Cleaner (7) | Ti Rinse (8) | MOLE PERCENT METAL CATIONS IN PHOSPHATE BATH $Ni^{+2}$ | $Zn^{+2}$ | $Mn^{+2}$ |
|---|---|---|---|---|---|---|---|---|---|---|---|---|
| 4. | 19.4 | 0.7 | 1.5 | 2.02 | 6.75 | 6.99 | 132 | 130 | 95 | 78.7 | 16.8 | 4.5 |
| 5. | 21.0 | 0.9 | 1.5 | 1.67 | 7.72 | 7.23 | 130 | 134 | 107 | 80.0 | 11.9 | 8.1 |
| 6. | 29.9 | 0.9 | 1.5 | 1.72 | 13.50 | 11.20 | 134 | 132 | 104 | 80.5 | 8.2 | 11.3 |
| 7. | 24.5 | 0.7 | 1.5 | 1.83 | 10.35 | 8.11 | 134 | | | 85.3 | 11.9 | 2.8 |
| 8. | 21.5 | 0.8 | 1.7 | 1.60 | 7.59 | 8.8 | 130 | 134 | 105 | 84.7 | 11.5 | 3.8 |
| 9. | 29.9 | 0.9 | 1.5 | 1.75 | 9.52 | 10.40 | 132 | 137 | 105 | 84.1 | 9.0 | 6.9 |
| 10. | 32.6 | 0.9 | 1.6 | 1.70 | 12.61 | 13.20 | 136 | 130 | 102 | 84.3 | 6.3 | 9.4 |
| 11. | 22.8 | 0.9 | 1.6 | 1.84 | 9.03 | 8.28 | 138 | | | 87.4 | 11.8 | 0.8 |
| 12. | 23.7 | 0.7 | 1.6 | 1.66 | 10.64 | 8.14 | | | | 86.7 | 12.3 | 1.0 |
| 13. | 22.7 | 0.7 | 1.6 | 1.71 | 8.89 | 8.30 | 136 | | | 86.4 | 12.3 | 1.3 |
| 14. | 25.0 | 1.0 | 1.5 | 1.71 | 9.89 | 10.10 | 130 | 130 | 105 | 86.8 | 9.1 | 4.1 |
| 15. | 34.1 | 1.0 | 1.5 | 1.98 | 12.96 | 13.90 | 136 | 126 | 110 | 87.1 | 6.0 | 6.9 |
| 16. | 32.4 | 0.9 | 1.5 | 1.98 | 11.69 | 12.28 | | | | 89.5 | 6.7 | 3.8 |
| 17. | 16.4 | 0.8 | 1.5 | 1.72 | 6.80 | 5.03 | 134 | | | 4.0 | 18.4 | 77.5 |
| 18. | 14.6 | 0.8 | 1.6 | 0.95 | 6.17 | 5.59 | 134 | 134 | 95 | 32.7 | 20.2 | 47.1 |
| 19. | 16.5 | 0.8 | 1.5 | 1.9 | 5.2 | 5.70 | 137 | 130 | 100 | 50.5 | 20.3 | 29.2 |
| 20. | 17.4 | 0.7 | 1.6 | 1.77 | 6.07 | 6.25 | 135 | | | 69.3 | 19.0 | 11.7 |

FOOTNOTES TO TABLE I
(1) points of total acid
(2) points of free acid
(3) points of nitrite ion
(4) grams per liter of fluoride ion
(5) grams per liter of phosphate ion
(6) grams per liter of nitrate ion
(7) Commercial Alkaline posphate cleaner 2338 of Parker Chemical Company
(8) titanium rinse with Parker Chemical Company product, Parcolene Z.

TABLE II

| Example | METAL CATIONS IN PHOSPHATE COATING Mole % $NI^{+2}$ | Mole % $Zn^{+2}$ | MOle % $Mn^{+2}$ | $MG/FT^2$ COATING WEIGHT |
|---|---|---|---|---|
| 1. | 12.5 | 87.5 | 0 | 103 |
| 2. | 14.9 | 85.1 | 0 | 98 |
| 3. | 20.3 | 79.7 | 0 | 99 |
| 4. | 9.6 | 86.0 | 4.4 | 111 |
| 5. | 11.0 | 81.4 | 7.6 | 110 |
| 6. | 12.8 | 75.2 | 12.0 | 109 |
| 7. | 13.8 | 83.0 | 3.2 | 99 |
| 8. | 13.7 | 81.6 | 4.7 | 92 |
| 9. | 13.0 | 79.2 | 7.8 | 103 |
| 10. | 14.8 | 73.8 | 11.4 | 98 |
| 11. | 15.0 | 83.9 | 1.1 | 95 |
| 12. | 14.5 | 84.0 | 1.5 | 93 |
| 13. | 13.9 | 84.2 | 1.9 | 93 |
| 14. | 14.1 | 81.1 | 4.8 | 113 |
| 15. | 16.5 | 74.3 | 9.20 | 101 |
| 16. | 17.2 | 77.0 | 5.8 | 94 |
| 17. | 1.1 | 70.9 | 28.1 | 125 |
| 18. | 1.4 | 77.1 | 21.5 | 122 |
| 19. | 3.8 | 80.4 | 15.8 | 127 |
| 20. | 7.4 | 83.8 | 8.8 | 107 |

We claim:

1. A method for applying a phosphate conversion coating to a corrodible metal substrate by exposing said substrate to an acidic, aqueous solution containing first, second, and third divalent metal cations, the method comprising (a) selecting nickel cations as said first divalent metal cations;

(b) selecting manganese cations as said second divalent metal cations;

selecting zinc cations as said third divalent metal cations;

(d) maintaining a minimum zinc cation concentration in said solution of 0.2 grams per liter;

(e) controlling the concentrations of said first, second and third divalent metal cations in said aqueous solution so that at the time of coating the concentration of said nickel cations is maintained between about 80 and 94 percent, the concentration of said manganese cations is maintained between about 0.5 and about 10 mole percent and the concentration of said zinc cations between about 5.5 and about 19.5 mole percent of the total of said first, second and third divalent metal cations in said solution; and (f) maintaining the total acid content of said solution in the range of 10 to 40 points, maintaining the free acid content of said solution in the range of 0.5 to 2.0 points and maintaining the total acid to free acid ratio in said solution in the range of 10 to 60 points.

2. A method in accordance with claim 1 wherein the concentration of said nickel cations in said solution is maintained in the range of 84 to 94 mole percent of the total of said first, second and third divalent metal cations in said solution.

3. A method in accordance with claim 1 wherein the concentration of said manganese cations in said solution is maintained at at least 2 mole percent of the total of said first, second and third divalent metal cations in said solution.

4. A method in accordance with claim 1 wherein the concentration of said manganese cations in said solution is maintained at at least 4 mole percent of the total of said first, second and third divalent metal cations in said solution.

5. A coated metal substrate having a phosphate conversion coating formed thereon by contacting said substrate with an acidic aqueous solution in the method of claim 1.

6. An aqueous concentrate for use in preparing a phosphating bath for deposition of a zinc phosphate conversion coating on a corrodible metal surface comprising water, phosphate ions, and about 2 to about 9 grams per liter manganese ions, about 6 to about 15 grams per liter zinc ions and about 82 to about 95 grams per liter nickel ions.

7. A concentrate for replenishing a phosphating bath after deposition bath therefrom of zinc phosphate conversion coatings comprising water, phosphate ions, and about 3 to about 15 grams per liter manganese ion, about 40 to about 60 grams per liter zinc ions and about 60 to about 90 grams per liter nickel ion.

* * * * *